US009175528B2

(12) United States Patent
Duman et al.

(10) Patent No.: US 9,175,528 B2
(45) Date of Patent: Nov. 3, 2015

(54) DECOMPRESSION TO FILL PRESSURE

(71) Applicant: Hydril USA Distribution LLC, Houston, TX (US)

(72) Inventors: Ahmet Duman, Houston, TX (US); Dat Manh Nguyen, Houston, TX (US); Devon Daniel, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 14/020,546

(22) Filed: Sep. 6, 2013

(65) Prior Publication Data

US 2014/0262506 A1 Sep. 18, 2014

Related U.S. Application Data

(60) Provisional application No. 61/791,466, filed on Mar. 15, 2013.

(51) Int. Cl.

| | |
|---|---|
| ***E21B 7/12*** | (2006.01) |
| ***E21B 21/00*** | (2006.01) |
| ***E21B 21/08*** | (2006.01) |
| ***E21B 21/10*** | (2006.01) |

(52) U.S. Cl.

CPC ..... *E21B 21/001* (2013.01); *E21B 21/08* (2013.01); *E21B 21/10* (2013.01)

(58) Field of Classification Search

CPC ..... E21B 43/121; E21B 21/001
USPC ..... 166/358; 175/5, 207, 217
See application file for complete search history.

(56) References Cited

U.S. PATENT DOCUMENTS

| | | | | |
|---|---|---|---|---|
| 2,703,055 | A | | 3/1955 | Veth et al. |
| 4,242,057 | A | * | 12/1980 | Bender ..... 417/404 |
| 4,406,595 | A | * | 9/1983 | Robertson et al. ..... 417/383 |
| 4,527,959 | A | * | 7/1985 | Whiteman ..... 417/342 |

(Continued)

FOREIGN PATENT DOCUMENTS

| | | | |
|---|---|---|---|
| EP | 1082515 | A1 | 3/2001 |
| WO | 2011051453 | A2 | 5/2011 |
| WO | 2012091706 | A1 | 7/2012 |

OTHER PUBLICATIONS

International Search Report and Written Opinion issued in connection with related PCT Application No. PCT/US2014/027742 on Jul. 24, 2014.

(Continued)

*Primary Examiner* — Matthew Buck
*Assistant Examiner* — Aaron Lembo
(74) *Attorney, Agent, or Firm* — Bracewell & Giuliani LLP

(57) ABSTRACT

A method and system for lifting drilling mud from subsea to a drilling vessel includes a pump having a body with a chamber, and a bladder in the chamber. The bladder spans the chamber to define water and mud sides in the chamber. A mud inlet valve allows mud into the mud side of the chamber; which moves the bladder into the water side and urges water from the water side of the chamber through a water exit valve. Pressurized water enters the chamber through a water inlet valve, which in turn pushes the bladder and mud from the chamber through a mud exit valve. The bladder separates the mud and water as it reciprocates in the chamber. A pressure control circuit equalizes pressure across the water valves, and a control valve provides a back pressure in a discharge of the pressure control circuit.

13 Claims, 4 Drawing Sheets

(56) References Cited

U.S. PATENT DOCUMENTS

| | | | | |
|---|---|---|---|---|
| 4,850,806 | A | 7/1989 | Morgan et al. | |
| 5,614,101 | A * | 3/1997 | DeWalls et al. | 516/161 |
| 6,102,673 | A | 8/2000 | Mott et al. | |
| 6,214,219 | B1 * | 4/2001 | Fisher | 210/180 |
| 6,328,107 | B1 * | 12/2001 | Maus | 166/335 |
| 6,454,542 | B1 * | 9/2002 | Back | 417/53 |
| 7,011,152 | B2 * | 3/2006 | Soelvik | 166/65.1 |
| 7,185,705 | B2 * | 3/2007 | Fontana | 166/356 |
| 7,264,058 | B2 * | 9/2007 | Fossli | 166/367 |
| 7,497,266 | B2 * | 3/2009 | Fossli | 166/358 |
| 8,165,722 | B2 * | 4/2012 | Yoon et al. | 700/282 |
| 8,322,439 | B2 * | 12/2012 | Fossli | 166/367 |
| 8,449,265 | B2 * | 5/2013 | Marica | 417/215 |
| 8,591,200 | B2 * | 11/2013 | Marica | 417/385 |
| 8,727,040 | B2 * | 5/2014 | Schroeder et al. | 175/232 |
| 2004/0007392 | A1 | 1/2004 | Judge et al. | |
| 2006/0201678 | A1 | 9/2006 | Judge et al. | |
| 2008/0105434 | A1 | 5/2008 | Orbell et al. | |
| 2009/0139769 | A1 | 6/2009 | Traylor | |
| 2012/0227978 | A1 * | 9/2012 | Fossli et al. | 166/363 |
| 2013/0192841 | A1 * | 8/2013 | Feasey et al. | 166/336 |
| 2014/0144703 | A1 * | 5/2014 | Fossli | 175/5 |
| 2014/0262305 | A1 * | 9/2014 | Duman et al. | 166/335 |

OTHER PUBLICATIONS

International Search Report and Written Opinion issued in connection with related PCT Application No. PCT/US2014/027928 on Jul. 24, 2014.

Ahmet Duman, et al., Sep. 6, 2013, U.S. Appl. No. 14/020,586.

Ahmet Duman, et al, Sep. 6, 2013, U.S. Appl. No. 14/020,568.

International Search Report and Written Opinion issued in connection with corresponding PCT Application No. PCT/US2014/027929 dated Oct. 22, 2014.

PCT Search Report and Written Opinion issued in connection with corresponding Application No. PCT/US2014/027792 on Jan. 12, 2015.

* cited by examiner

DECOMPRESSION TO FILL PRESSURE

CROSS REFERENCE TO RELATED APPLICATIONS

This application claims priority to and the benefit of U.S. Provisional Application Ser. No. 61/791,466, filed Mar. 15, 2013, the full disclosure of which is hereby incorporated by reference herein for all purposes.

BACKGROUND OF THE INVENTION

1. Field of Invention

The present disclosure relates in general to a system and method for maintaining backpressure in a seawater discharge line of a bladder pump.

2. Description of Prior Art

Subsea drilling systems typically employ a vessel at the sea surface, a riser connecting the vessel with a wellhead housing on the seafloor, and a drill string. A drill bit is attached on a lower end of the drill string, and used for excavating a borehole through the formation below the seafloor. The drill string is suspended subsea from the vessel into the riser, and is protected from seawater while inside of the riser. Past the lower end of the riser, the drill string inserts through the wellhead housing just above where it contacts the formation. Generally, a rotary table or top drive is provided on the vessel for rotating the string and bit. Drilling mud is usually pumped under pressure into the drill string, and is discharged from nozzles in the drill bit. The drilling mud, through its density and pressure, controls pressure in the well and cools the bit. The mud also removes formation cuttings from the well as it is circulated back to the vessel. Traditionally, the mud exiting the well is routed through an annulus between the drill string and riser. However, as well control depends at least in part on the column of fluid in the riser, the effects of corrective action in response to a well kick or other anomaly can be delayed.

Fluid lift systems have been deployed subsea for pressurizing the drilling mud exiting the wellbore. Piping systems outside of the riser carry the mud pressurized by the subsea lift systems. The lift systems include pumps disposed proximate the wellhead, which reduce the time for well control actions to take effect.

SUMMARY OF THE INVENTION

Disclosed herein is system for lifting mud from a subsea wellbore to sea surface. In one example, the system includes a mud pump in fluid communication with a flow of mud from the subsea wellbore, a working fluid supply line in communication with the mud pump and having a supply of working fluid, a working fluid discharge line in communication with the mud pump and having a flow of working fluid discharged from the mud pump, and a pressure control circuit having an upstream end in communication with the working fluid supply line and a downstream end in selective communication with the working fluid discharge line. A lead line can be included that is in a flow path between the mud pump and the working fluid supply line, where an inlet valve is in the lead line, and where the pressure control circuit selectively equalizes pressure in portions of the lead line on opposite sides of the inlet valve. In one example, the downstream end of the pressure control circuit selectively communicates to ambient of the system. In an embodiment, the mud pump is made up of a housing having a chamber, a bladder in the chamber with an outer periphery that is in sealing contact with an inner surface of the housing to define a mud space and a working fluid space. In this example, selectively communicating the downstream end of the pressure control circuit with the working fluid discharge line maintains a back pressure in the working fluid space to resist a surge of mud flow into the mud space. The system can further include a plurality of mud pumps, wherein each of the mud pumps is in communication with the flow of mud, the working fluid supply line, and the working fluid discharge line. In this example, the plurality of mud pumps includes a module, the system further being made up of a plurality of modules. A control valve is optionally included in the working fluid discharge line for controlling the flow of working fluid in the working fluid discharge line, and a flow meter in the working fluid discharge line upstream of the control valve and that is in signal communication with the control valve. The working fluid can be sea water.

Also disclosed herein is a system for pumping mud subsea which includes a water supply line and a series of mud pumps. In this example, each mud pump includes a housing having an attached manifold, a selectively opened and closed water inlet valve having an end in communication with the manifold and an end in communication with the water supply line, a water space in the housing in communication with the manifold, a selectively opened and closed water exit valve having an end in communication with the manifold and an end in communication with a water discharge line, a mud space in the housing that is in pressure communication with the water space, and a bladder mounted in the housing having a side in contact with the water space and an opposing side in contact with the mud space. Where the bladder defines a flow barrier between the water and mud space. In this example the system also includes a pressure control circuit having an upstream end in communication with the water supply line and a downstream end selectively switchable between communication to ambient of the pressure control circuit and communication with the water discharge line. Optionally, the mud space in each pump is in fluid communication with mud flowing in a mud return line, and wherein selectively flowing water into the water space pressurizes the mud for return to sea surface. In this example, when a pressure of the mud entering the pumps communication of the downstream end to ambient switches to communication with the water discharge line when pressure of the mud exceeds a threshold value. A control valve may optionally be included in the water discharge downstream of where the pressure control circuit communicates with the water discharge. The pressure control circuit can selectively equalize pressure across each water inlet valve.

Another embodiment of a system for lifting mud from a subsea wellbore to above the sea surface includes a series of pump modules each having mud pumps. In this example, each mud pump includes a housing in communication with a water supply line, a water discharge line, a mud supply line, and a mud discharge line, and a bladder that selectively pushes mud from the housing in response to flowing water into the housing, and pushes water from the housing in response to mud flowing into the housing. Further included in this example is a means for resisting an influx of mud into the housing when a pressure of the mud exceeds a threshold value by creating a backpressure in the water discharge line. Optionally included with this embodiment is a means for equalizing pressure across water inlet valves disposed in water lead lines that connect the water supply line to each of the housings.

BRIEF DESCRIPTION OF DRAWINGS

Some of the features and benefits of the present invention having been stated, others will become apparent as the description proceeds when taken in conjunction with the accompanying drawings, in which.

Figure 1:
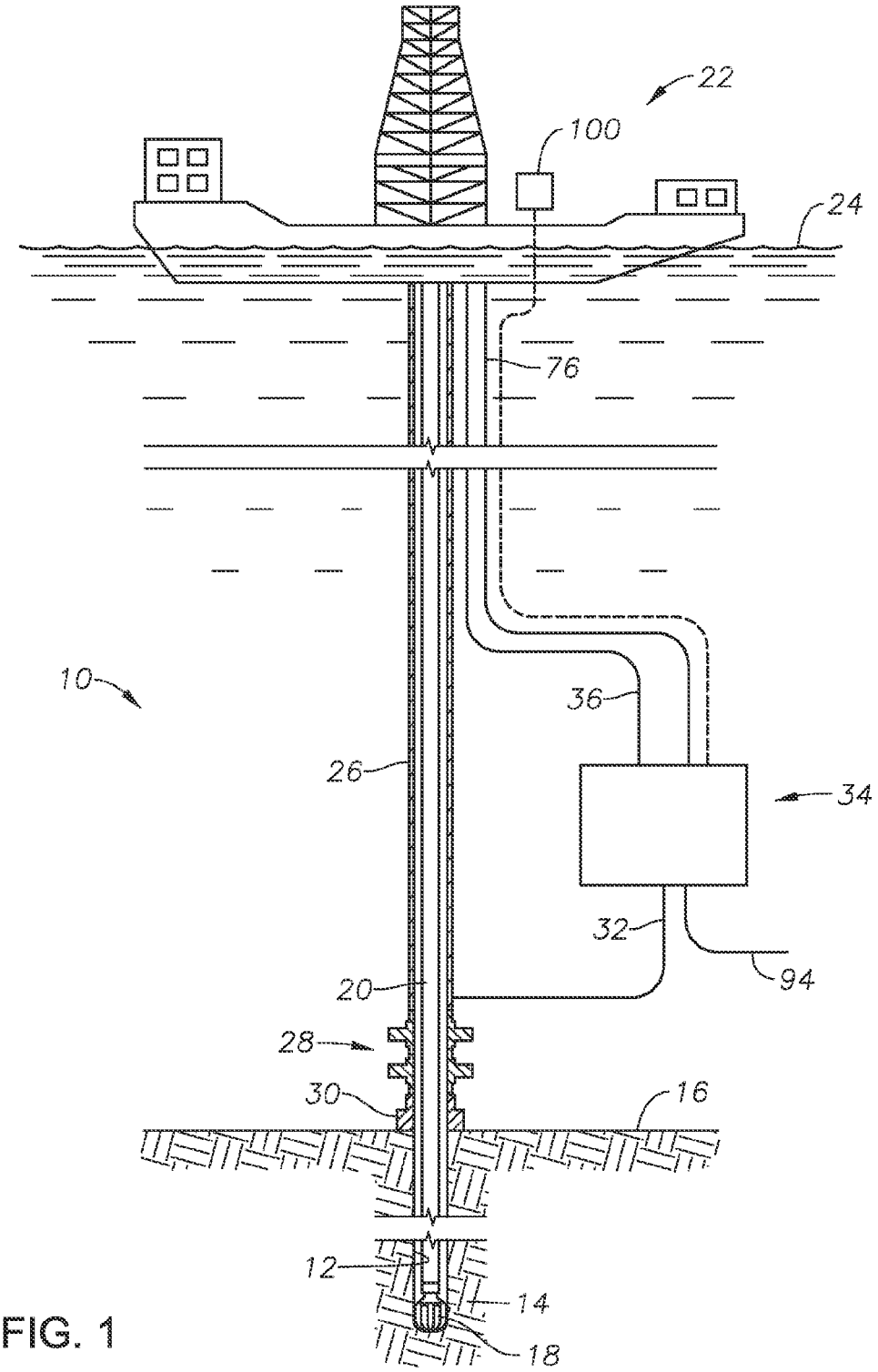
FIG. 1 is a side sectional view of an example of a subsea drilling system in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in FIG. 1 is a side partial sectional view of an example embodiment of a drilling system 10 for forming a wellbore 12 subsea. The wellbore 12 intersects a formation 14 that lies beneath the sea floor 16. The wellbore 12 is formed by a rotating bit 18 coupled on an end of a drill string 20 shown extending subsea from a vessel 22 floating on the sea surface 24. The drill string 20 is isolated from seawater by an annular riser 26; whose upper end connects to the vessel 22 and lower end attaches onto a blowout preventer (BOP) 28. The BOP 28 mounts onto a wellhead housing 30 that is set into the sea floor 16 over the wellbore 12. A mud return line 32 is shown having an end connected to the riser 26 above BOP 28, which routes drilling mud exiting the wellbore 12 to a lift pump assembly 34 schematically illustrated subsea. Within the lift pump assembly 34, drilling mud is pressurized for delivery back to the vessel 22 via mud return line 36.

Figure 2:
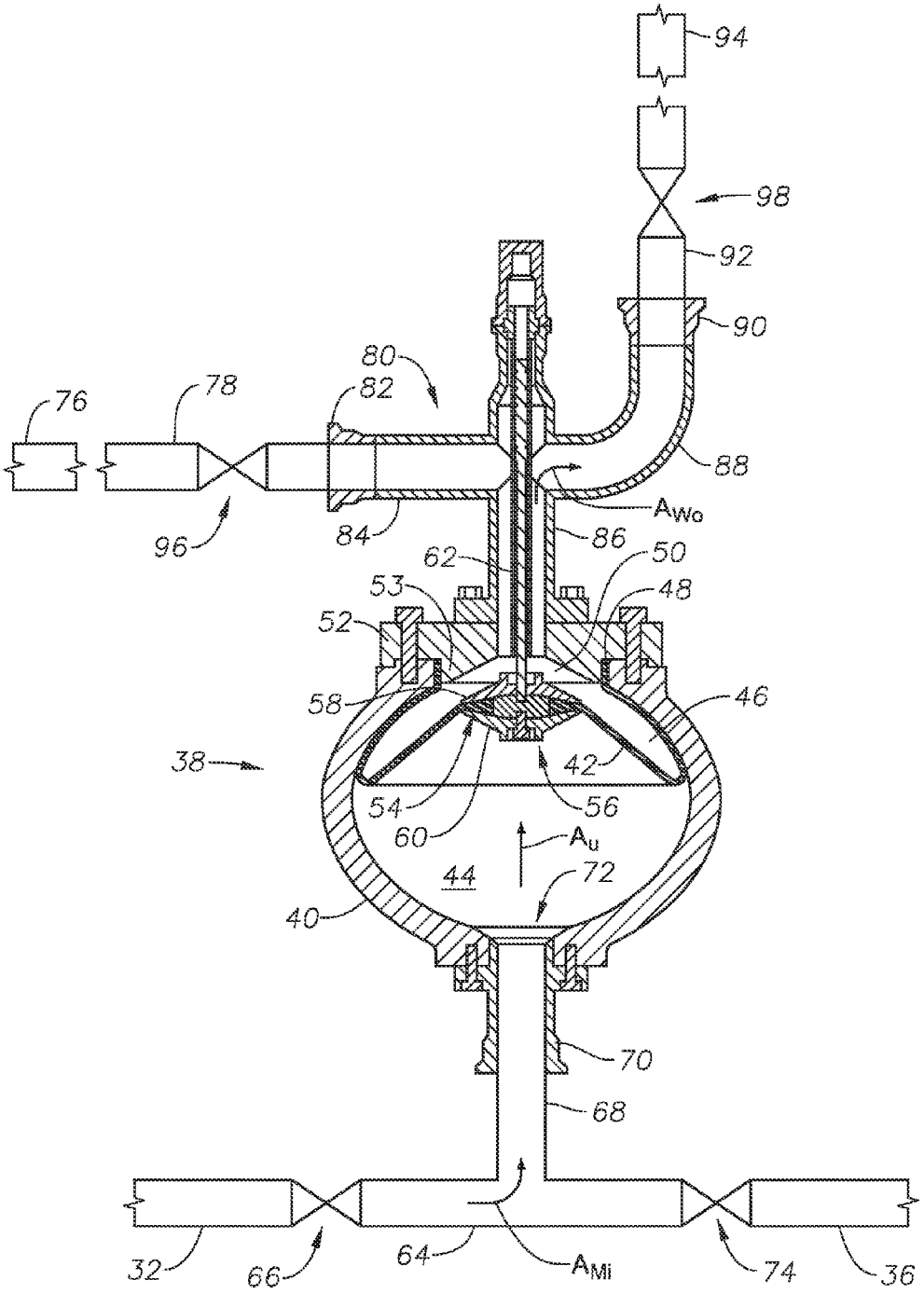
FIGS. 2 and 3 are partial side sectional views of an example of a subsea pump for use with the drilling system of FIG. 1 in different pumping modes and in accordance with the present invention.

FIG. 2 includes a side sectional view of an example of a pump 38 for use with lift pump assembly 34 (FIG. 1). Pump 38 includes a generally hollow and elliptically shaped pump housing 40. Other shapes for the housing 40 include circular and rectangular, to name a few. An embodiment of a flexible bladder 42 is shown within the housing 40; which partitions the space within the housing 40 to define a mud space 44 on one side of the bladder 42, and a water space 46 on an opposing side of bladder 42. As will be described in more detail below, bladder 42 provides a sealing barrier between mud space 44 and water space 46. In the example of FIG. 2, bladder 42 has a generally elliptical shape and an upper open space 48 formed through a side wall. Upper open space 48 is shown coaxially registered with an opening 50 formed through a side wall of pump housing 40. A disk-like cap 52 bolts onto opening 50, where cap 52 has an axially downward depending lip 53 that coaxially inserts within opening 50 and upper open space 48. A portion of the bladder 42 adjacent its upper open space 48 is wedged between lip 53 and opening 50 to form a sealing surface between bladder 42 and pump housing 40.

A lower open space 54 is formed on a lower end of bladder 42 distal from upper open space 48, which in the example of FIG. 2 is coaxial with upper open space 48. An elliptical bumper 56 is shown coaxially set in the lower open space 54. The bumper 56 includes upper and lower segments 58, 60 coupled together in a clam shell like arrangement, and that respectively seal against upper and lower radial surfaces on the lower open space 54. The combination of sealing engagement of cap 52 and bumper 56 with upper and lower open spaces 42, 54 of bladder 42, effectively define a flow barrier across the opposing surfaces of bladder 42. Further shown in the example of FIG. 2 is an axial rod 62 that attaches coaxially to upper segment 56 and extends axially away from lower segment 58 and through opening 50.

Still referring to FIG. 2, a mud line 64 is shown having an inlet end connected to mud return line 32, and an exit end connected with mud return line 36. A mud inlet valve 66 in mud line 64 provides selective fluid communication from mud return line 32 to a mud lead line 68 shown branching from mud line 64. Lead line 68 attaches to an annular connector 70, which in the illustrated example is bolted onto housing 40. Connector 70 mounts coaxially over an opening 72 shown formed through a sidewall of housing 40 and allows communication between mud space 44 and mud line 64 through lead line 68. A mud exit valve 74 is shown in mud line 64 and provides selective communication between mud line 64 and mud return line 36.

Water may be selectively delivered into water space 46 via a water supply line 76 (FIG. 1) shown depending from vessel 22 and connecting to lift pump assembly 34. Referring back to FIG. 2, a water inlet lead line 78 has an end coupled with water supply line 76 and an opposing end attached with a manifold assembly 80 that mounts onto cap 52. The embodiment of the manifold assembly 80 of FIG. 2 includes a connector 82, mounted onto a free end of a tubular manifold inlet 84, an annular body 86, and a tubular manifold outlet 88, where the inlet and outlet 84, 88 mount on opposing lateral sides of the body 86 and are in fluid communication with body 86. Connector 82 provides a connection point for an end of water inlet lead line 78 to manifold inlet 84 so that lead line 78 is in communication with body 86. A lower end of manifold body 86 couples onto cap 52; the annulus of the manifold body 86 is in fluid communication with water space 46 through a hole in the cap 52 that registers with opening 50. An outlet connector 90 is provided on an end of manifold outlet 88 distal from manifold body 86, which has an end opposite its connection to manifold outlet 88 that is attached to a water outlet lead line 92. On an end opposite from connector 90, water outlet lead line 92 attaches to a water discharge line 94; that as shown in FIG. 1, may optionally provide a flow path directly subsea.

A water inlet valve 96 shown in water inlet lead line 78 provides selective water communication from vessel 22 (FIG. 1) to water space 46 via water inlet lead line 78 and manifold assembly 80. A water outlet valve 98 shown in water outlet lead line 92 selectively provides communication between water space 46 and water discharge line 94 through manifold assembly 80 and water outlet lead line 92.

In one example of operation of pump 38 of FIG. 2 mud inlet valve 66 is in an open configuration, so that mud in mud return line 32 communicates into mud line 64 and mud lead line 68 as indicated by arrow $A_{Mi}$. Further in this example, mud exit valve 74 is in a closed position thereby diverting mud flow into connector 70, through opening 72, and into mud space 44. As illustrated by arrow $A_U$, bladder 42 is urged in a direction away from opening 72 by the influx of mud, thereby imparting a force against water within water space 46. In the example, water outlet valve 98 is in an open position, so that water forced from water space 46 by bladder 42 can flow through manifold body 86 and manifold outlet 88 as illustrated by arrow $A_{Wo}$. After exiting manifold outlet 88, water is routed through water outlet lead line 92 and into water discharge line 94.

Figure 3:
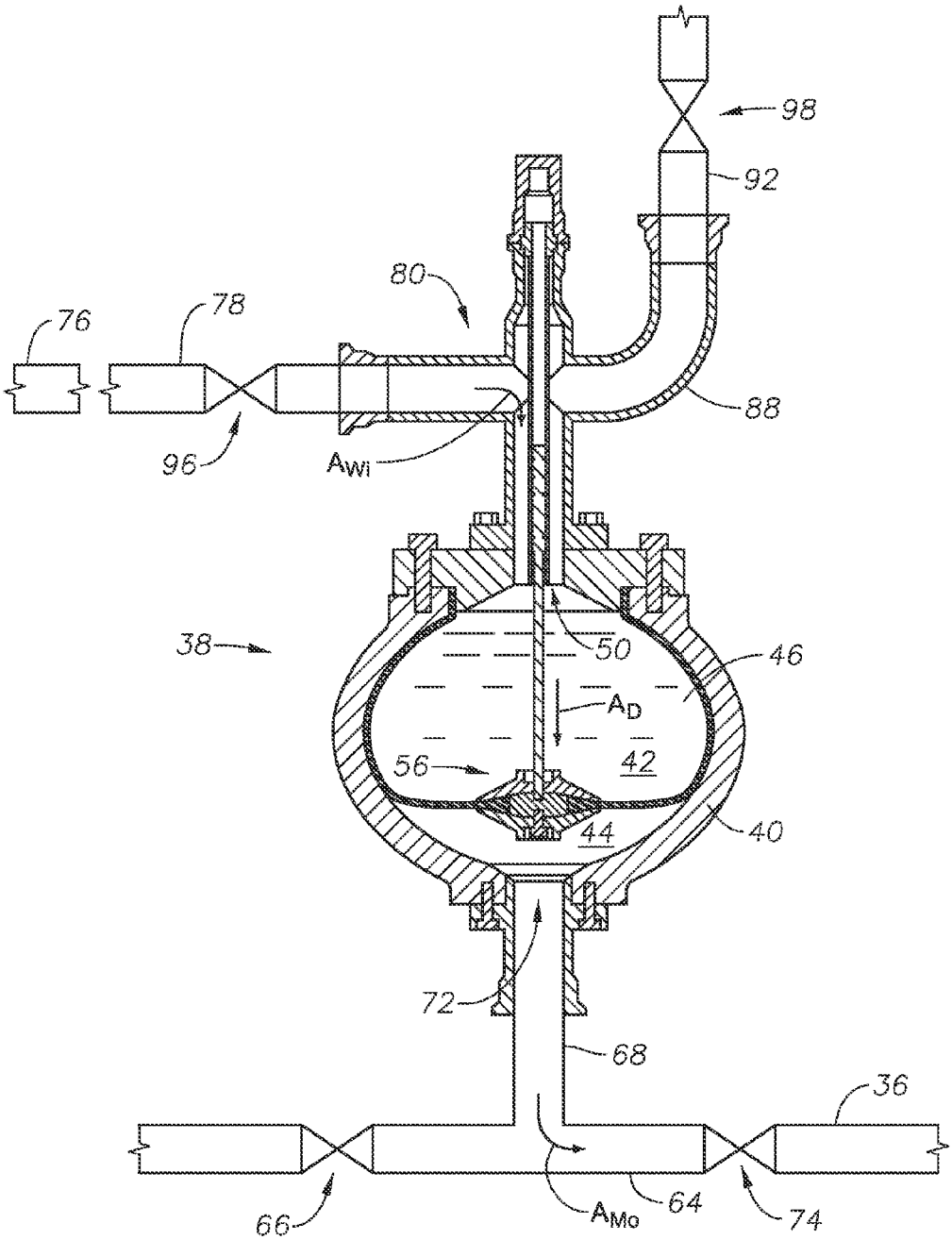

An example of pressurizing mud within mud space 44 is illustrated in FIG. 3, wherein valves 66, 98 are in a closed position and valves 96, 74 are in an open position. In this example, pressurized water from water supply line 76 is free to enter manifold assembly 80 where as illustrated by arrow $A_{Wi}$, the water is diverted through opening 50 and into water space 46. Introducing pressurized water into water space 46 urges bladder 42 in a direction shown by arrow $A_D$. Pressurized water in the water space 46 urges bladder 42 against the mud, which pressurizes mud in mud space 44 and directs it through opening 72. After exiting opening 72, the pressurized mud flows into lead 68, where it is diverted to mud return line 36 through open mud exit valve 74 as illustrated by arrow $A_{Mo}$. Thus, providing water at a designated pressure into water supply line 76 can sufficiently pressurize mud within mud return line 36 to force mud to flow back to vessel 22 (FIG. 1).

Figure 4:
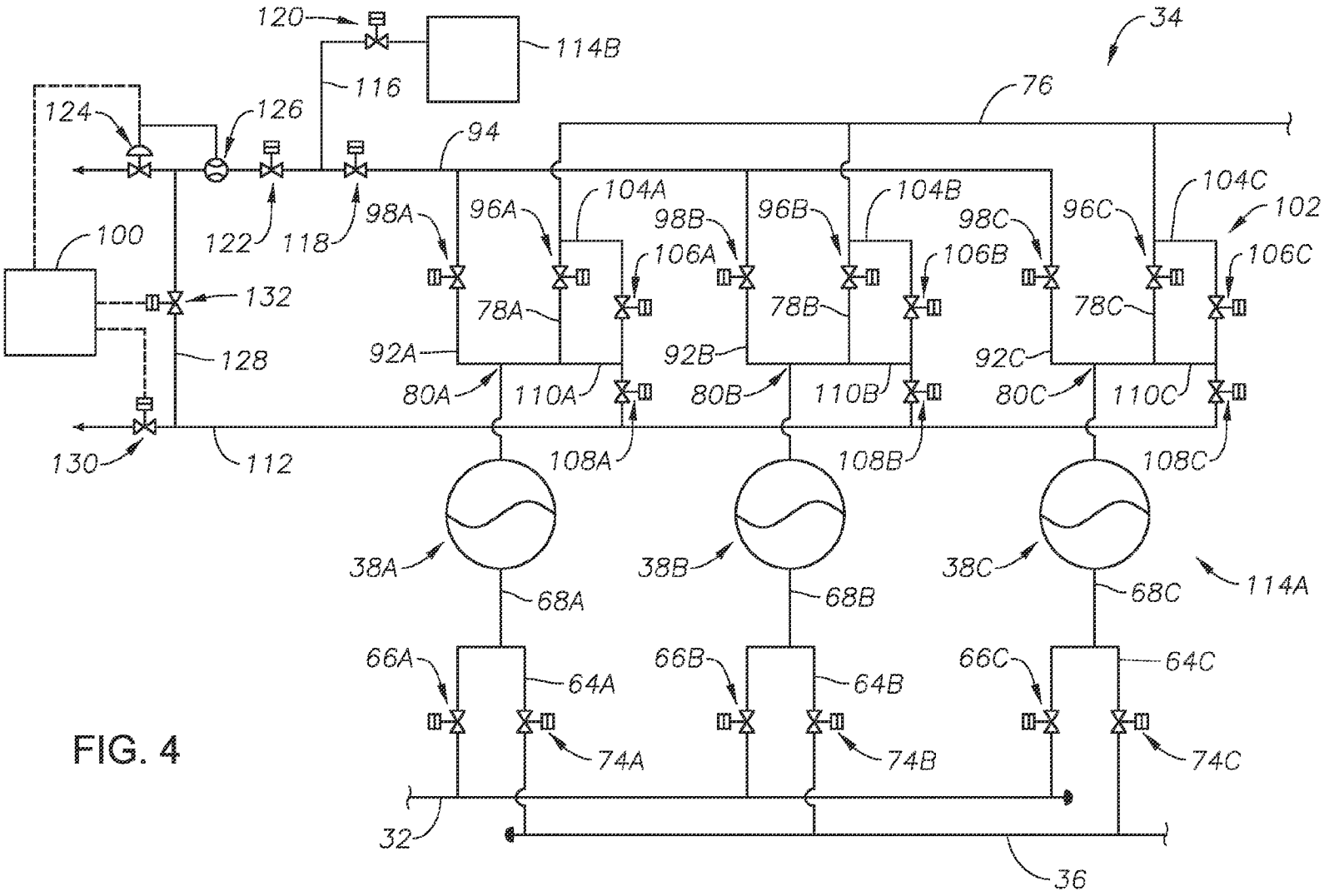
FIG. 4 is a schematic representation of an example of a lift pump assembly having backpressure control on a seawater discharge line and in accordance with the present invention.

FIG. 4 is a schematic illustration of an example of a lift pump assembly 34 having pumps 38A-C arranged in parallel. In this example, and similar to that of FIG. 2, mud flows to pumps 38A-C respectively from mud lines 64A-C that each have an inlet end connected to mud return line 32. Outlet ends of the mud lines 64A-C discharge into mud return line 36. Leads 68A-C respectively communicate mud flow between pumps 38A-C and lines 64A-C, where valves 66A-C, 74A-C respectively regulate flow through lines 64A-C. In similar fashion, water from water supply line 76 flows to pumps 38A-C via water inlet lead lines 78A-C and manifold assemblies 80A-C; and water from pumps 38A-C is delivered to water discharge line 94 via manifold assemblies 80A-C and water outlet lead lines 92A-C. Water to and from pumps 38A-C is controlled by valves 96A-C and 98A-C, which are shown respectively in lines 78A-C and lines 92A-C. Optionally, one or more of valves 66A-C, 74A-C, 96A-C, 98A-C, 106A-C, 108A-C may be in communication with a controller 100 for selective opening and/or closing the valves, or throttling flow through the valves.

The lift pump assembly 34 of FIG. 4 is equipped with a pressure balance circuit 102 for minimizing a pressure differential across valves 96A-C. In the example of FIG. 4, pressure balance circuit 102 includes pressurization tubing 104A-C, each having inlets respectively connected to water inlet lead lines 78A-C. Optionally, pressurization tubing 104A-C can connect directly to water supply line 76. Pressurization valves 106A-C are provided within each run of pressurization tubing 104A-C. Each run of tubing 104A-C includes depressurization valves 108A-C downstream of pressurization valves 106A-C. Tubing leads 110A-C branch respectively from pressurization tubing 104A-C in the portions between pressurization valves 106A-C and depressurization valves 108A-C. The ends of tubing 110A-C distal from pressurization tubing 104A-C connect to water inlet lead lines 78A-C downstream of inlet valves 96A-C. In an example of operation, when water is being discharged from pumps 38A-C, outlet valves 98A-C are in the open position, and inlet valves 96A-C are in the closed position, a pressure differential can exist across inlet valves 96A-C that can approach pressure in water supply line 76. Further in this example, opening valves 106A-C, while valves 96A-C and 108A-C are in a closed position, communicates pressure from line 76 through pressurization tubing 104A-C, tubing leads 110A-C, and into inlet lead lines 78A-C downstream of valves 96A-C. In this example embodiment, fluid in lines 78A-C upstream and downstream of valves 96A-C is in pressure communication with line 76, thereby minimizing pressure differential across valves 96A-C.

Downstream of valves 108A-C, pressurization tubing 104A-C connects to a tubing header 112, through which water in the pressure balance circuit 102 can be discharged to ambient. In the example of FIG. 4, pumps 38A-C and the associated piping disclosed herein are referred to as a pump module 114A. Example embodiments exist wherein the lift pump assembly 34 includes two or more modules. As such, a water discharge line 116 from another module 114B, that is substantially similar to module 114A. Block valves 118, 120 are respectively provided in discharge lines 94, 116 for isolating water flow from modules 114A, 114B. Also in line 94 is an optional block valve 122 downstream of the intersection of line 116 with line 94; and a control valve 124 and flow meter 126 downstream of block valve 122. An optional bypass line 128 connects tubing header 112 to water discharge line 94 between control valve 124 and flow meter 126. A block valve 130 is shown in tubing header 112 downstream of bypass line 128, and a block valve 132 is provided in bypass line 128. In an alternative embodiment, block valves 130, 132 are in communication with controller 100.

Still referring to the example of FIG. 4, line 94 discharges to ambient downstream of control valve 124, thus depending on the flow rate of fluid in line 94, pressure in line 94 downstream of control valve 124 is substantially equal to ambient pressure. In the illustrated embodiment, control valve 124 and flow meter 126 are shown in communication with one another, so that a flow area through control valve 124 automatically adjusts in response to a flow rate detected by flow meter 126 to "throttle" flow across control valve 124. Optionally as shown, control valve 124 is in communication with controller 100, so that the amount of throttling can vary based on operating conditions of the lift pump assembly 34. As such, a pressure differential can be generated across control valve 124 so that pressure in line 94 upstream of control valve 124 is greater than pressure at ambient and introduces a backpressure in line 94. Where the backpressure in line 94 suppresses flow rate spikes in lines 92A-C, which in turn reduces cycling forces on components of pumps 38A-C during pumping operations.

In some examples of use, pumps 38A-C operate under "managed pressure drilling operations" where mud flow rates are reduced, but pressure of the mud to the pumps 38A-C is increased. During these conditions, the flow path to ambient through the pressure balance circuit 102 and from lines 78A-C can allow pressure in pumps 38A-C to drop below a threshold value so that pumps 38A-C will uncontrollably fill with mud during a subsequent pumping cycle. One example of operation to address the unacceptable pressure drop includes diverting flow in tubing header 112 that is being discharged from pressure balance circuit 102 through bypass line 128. In this example, block valve 130 is set into a closed position and block valve 132 is open. In an optional example, controller 100 delivers instructions for opening/closing of the block valves 130, 132. As indicated above, bypass line 128 terminates into water discharge line 94 upstream of control valve 124, which is maintained at a pressure sufficiently above ambient so that a backpressure can be exerted onto pressure balance circuit 102. In the example of FIG. 4, the backpressure on the pressure balance circuit 102 communicates to the water side 46 (FIG. 2) of each pump 38A-C; which maintains a minimum pressure in the water side 46 of each of the pumps 38A-C to avoid an uncontrolled influx of mud flow into the pumps 38A-C.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for lifting drilling mud from a subsea wellbore comprising:

a mud pump in fluid communication with a flow of mud from the subsea wellbore;

a working fluid supply line in communication with the mud pump and having a supply of working fluid;

a working fluid discharge line in communication with the mud pump and having a flow of working fluid discharged from the mud pump, the working fluid discharge line having a flow meter and a control valve; and a pressure control circuit having a pressurization line at an upstream end in communication with the working fluid supply line and a bypass line at a downstream end in selective communication with the working fluid discharge line at a point upstream of the control valve;

the control valve adjustable in response to a flow rate of the working fluid as measured by the flow meter of the working fluid discharge line to reduce flow through the control valve and increase pressure in the working fluid discharge line.

2. The system of claim 1, further comprising a lead line in a flow path between the mud pump and the working fluid supply line, an inlet valve in the lead line, and wherein the pressure control circuit selectively equalizes pressure in portions of the lead line on opposite sides of the inlet valve.

3. The system of claim 1, wherein the downstream end of the pressure control circuit selectively communicates to ambient of the system through the control valve.

4. The system of claim 1, wherein the mud pump comprises a housing having a chamber, a bladder in the chamber with an outer periphery that is in sealing contact with an inner surface of the housing to define a mud space and a working fluid space, and wherein adjusting the control valve to increase pressure in the working fluid discharge line maintains a back pressure in the working fluid space to resist a surge of mud flow into the mud space.

5. The system of claim 1, further comprising a plurality of mud pumps, wherein each of the mud pumps is in communication with the flow of mud, the working fluid supply line, and the working fluid discharge line.

6. The system of claim 5, wherein the plurality of mud pumps comprises a module, the system further comprising a plurality of modules.

7. The system of claim 1, wherein the working fluid comprises sea water.

8. A system for pumping mud subsea comprising:

a water supply line;

a series of mud pumps, each mud pump comprising, a housing having an attached manifold, a selectively opened and closed water inlet valve having an end in communication with the manifold and an end in communication with the water supply line, a water space in the housing in communication with the manifold, a selectively opened and closed water exit valve having an end in communication with the manifold and an end in communication with a water discharge line;

a mud space in the housing that is in pressure communication with the water space, a bladder mounted in the housing having a side in contact with the water space and an opposing side in contact with the mud space, and that defines a flow barrier between the water and mud space; and a pressure control circuit having a pressurization line at an upstream end in communication with the water supply line and a bypass line at a downstream end selectively switchable between communication to ambient of the pressure control circuit and communication with the water discharge line.

9. The system of claim 8, wherein the mud space in each pump is in fluid communication with mud flowing in a mud return line, and wherein selectively flowing water into the water space pressurizes the mud for return to sea surface.

10. The system of claim 9, wherein when a pressure of the mud entering the pumps exceeds a threshold value, the downstream end switches from communication with the ambient line to communication with the water discharge line when pressure of the mud exceeds a threshold value.

11. The system of claim 8, further comprising a control valve in the water discharge downstream of where the pressure control circuit communicates with the water discharge.

12. The system of claim 8, wherein the pressure control circuit selectively equalizes pressure across each water inlet valve.

13. A system for lifting mud from a subsea wellbore to above the sea surface comprising:

a series of pump modules that each comprise mud pumps with a housing in communication with a water supply line, a water discharge line, a mud supply line, and a mud discharge line, and a bladder that selectively pushes mud from the housing in response to flowing water into the housing, and pushes water from the housing in response to mud flowing into the housing;

a means for resisting an influx of mud into the housing when a pressure of the mud exceeds a threshold value by creating a backpressure in the water discharge line; and a means for equalizing pressure across a water inlet valve of each of the pump modules disposed in water lead lines that connect the water supply line to each of the housings.

* * * * *